US007203418B1

(12) United States Patent
York et al.

(10) Patent No.: US 7,203,418 B1
(45) Date of Patent: Apr. 10, 2007

(54) ELECTRIC WATER HEATER WITH HOT WATER OUTLET DIP TUBE

(75) Inventors: James York, Gray, TN (US); Don Pridemore, Jonesborough, TN (US)

(73) Assignee: American Water Heater Company, Atlanta, GA (US)

( * ) Notice: Subject to any disclaimer, the term of this patent is extended or adjusted under 35 U.S.C. 154(b) by 0 days.

(21) Appl. No.: 11/243,542

(22) Filed: Oct. 5, 2005

(51) Int. Cl.
*F24H 1/18* (2006.01)

(52) U.S. Cl. ..... 392/449; 392/441

(58) Field of Classification Search ..... None
See application file for complete search history.

(56) References Cited

U.S. PATENT DOCUMENTS 2,784,291 A * 3/1957 Harney ..... 392/452
3,715,566 A * 2/1973 Wasson ..... 392/457
3,776,456 A * 12/1973 Eising ..... 236/93 R
4,419,567 A * 12/1983 Murphy et al. ..... 392/451
4,898,150 A * 2/1990 Lewis ..... 122/19.1
5,054,437 A * 10/1991 Kale ..... 122/19.1
5,168,546 A * 12/1992 Laperriere et al. ..... 392/454
5,317,670 A * 5/1994 Elia ..... 392/464
5,341,770 A * 8/1994 Lannes ..... 122/383
5,596,952 A * 1/1997 Lannes et al. ..... 122/14.1
6,138,614 A * 10/2000 Shropshire ..... 122/13.3
6,282,372 B1 * 8/2001 Boros et al. ..... 392/500
6,370,328 B1 * 4/2002 Mottershead ..... 392/452

* cited by examiner

*Primary Examiner*—Thor Campbell
(74) *Attorney, Agent, or Firm*—DLA Piper US LLP

(57) ABSTRACT

An electric water heater including a water container; an element associated with the water container to heat water in the water container; a cold water inlet associated with the water container; a hot water outlet associated with the water container; and a dip tube connected to the hot water outlet, the dip tube having at least one opening proximate the hot water outlet and at least one opening positioned proximate to or below the element.

23 Claims, 2 Drawing Sheets

ELECTRIC WATER HEATER WITH HOT WATER OUTLET DIP TUBE

FIELD OF THE INVENTION

This invention relates to electric water heaters, particularly to energy efficient electric water heaters having an improved first hour rating.

BACKGROUND

The water heater industry has for many years attempted to manufacture water heaters that are more energy efficient. Various improvements have been made over the years, including better insulation of the water tank and implementation of microcontrollers to better control the heating elements and utilize a decreased amount of energy to produce hot water. While substantial progress has been made, there is still significant room for improvement.

Also, in the case of electric water heaters, they have a disadvantage relative to gas water heaters with respect to first hour ratings. Thus, there is a need to provide electric water heaters with better first hour ratings.

SUMMARY OF THE INVENTION

This invention relates to an electric water heater including a water container; an element associated with the water container to heat water in the water container; a cold water inlet associated with the water container; a hot water outlet associated with the water container; and a dip tube connected to the hot water outlet, the dip tube having at least one opening proximate the hot water outlet and at least one opening positioned proximate to or below the element.

This invention also relates to an electric water heater including a water tank; an upper element associated with the tank to heat water in the tank; a lower element associated with the tank to heat water in the tank; a cold water inlet positioned in a top portion of the tank; a hot water outlet positioned in the top portion of the tank; and a dip tube connected to the hot water outlet and having a plurality of upper openings positioned between the top portion and the upper element, and a plurality of lower openings positioned proximate to or below the upper element.

This invention further relates to a method of increasing first hour hot water supply from an electric water heater including a water tank, a heating element, a cold water inlet and a hot water outlet, including: reducing the temperature of hot water passing through the hot water outlet by causing relatively colder water in the tank to mix with relatively hotter water in the tank by connecting a dip tube having at least one opening proximate the hot water outlet and at least one opening positioned proximate to or below the element such that the relatively hotter water enters through the at least one opening proximate the hot water outlet and the relatively colder water enters to the hot water outlet through the at least one opening proximate to or below the element.

This invention still further relates to a method of increasing first hour water supply from an electric water heater including a water tank, an element, a cold water inlet and a hot water outlet, including: mixing relatively colder water in the tank with relatively hotter water in the tank with a dip tube having at least one opening adjacent a top portion of the tank and at least one opening positioned proximate to or below the element and connected to the hot water outlet.

DETAILED DESCRIPTION

Figure 1:
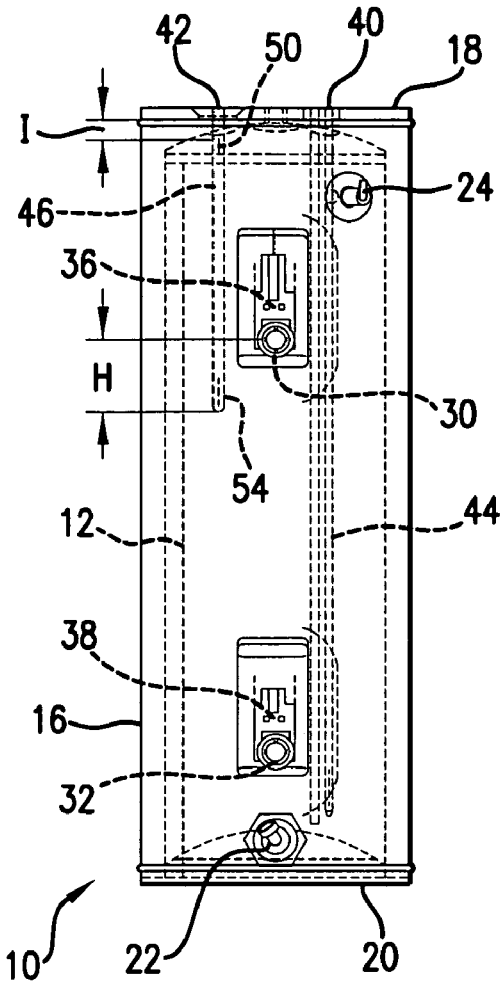
FIG. 1 is a schematic front elevational view of an electric water heater in accordance with aspects of the invention, wherein dashed lines indicate internal features.

It will be appreciated that the following description is intended to refer to specific aspects of the invention selected for illustration in the drawings and is not intended to define or limit the invention, other than in the appended claims.

Figure 2:
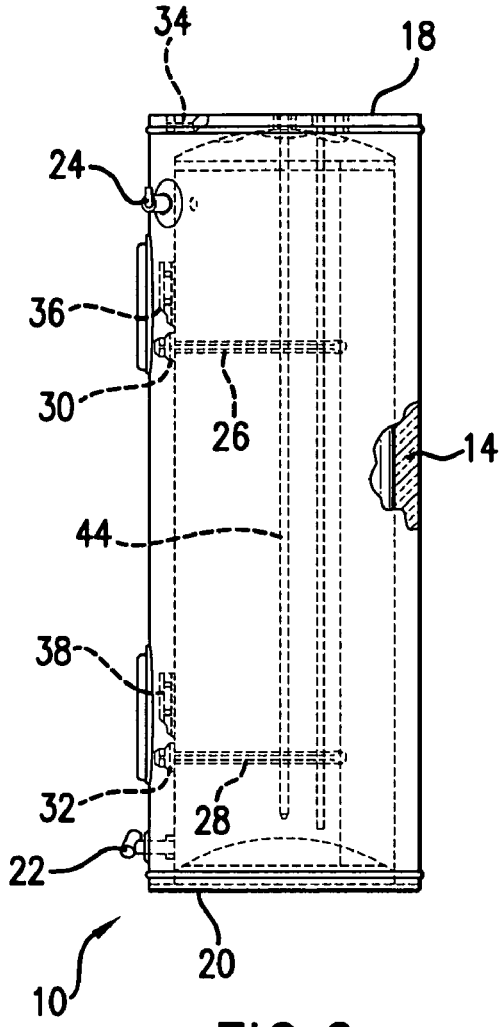
FIG. 2 is a schematic front elevational view of the water heater of FIG. 1, rotated by 90°.
Figure 3:
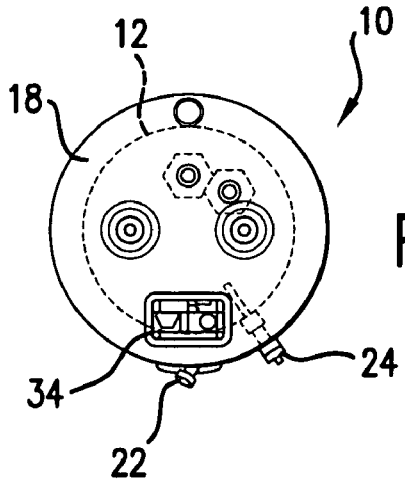
FIG. 3 is a top plan view of the water heater shown in FIGS. 1 and 2.

FIGS. 1–3 show an electric water heater 10 in accordance with aspects of the invention. Water heater 10 includes a water tank 12 surrounded by foam insulation 14 which is in itself surrounded by outer jacket 16. Outer jacket 16 is capped on its upper end by a top pan 18 and on its lower end by a bottom pan 20. A drain valve 22 is located near the bottom pan and extends outwardly from tank 12, though foam insulation 14 and outer jacket 16. Similarly, a temperature and pressure relief valve 24 is located near the top of water heater 10 and extends outwardly from tank 12, through foam insulation 14 and outer jacket 16.

Water in tank 12 is heated with an upper element 26 and a lower element 28. Upper element 26 connects to the side of tank 12 and typically includes a mounting base 30 along with a sensing device such as a thermistor (not shown). Lower element 28 has a similar mounting base 32 and a similar sensing element such as a thermistor (not shown). Both of elements 26 and 28 connect to a control device which, in this case, is microcontroller 34 positioned in a recess in top pan 18. The controller is also connected to an upper thermostat 36 and a lower thermostat 38 which operatively connect to elements 26 and 28, respectively. This is only one of many possible arrangements. For example, it is possible to employ "standard" electromechanical thermostats, electronic controls with thermistors and the like. In any event, the manner of controlling the electrical portion of the water heater is not critical to this invention.

Water heater 10 also has a cold water inlet 40 extending from the top of tank 12 through top pan 18. Similarly, water heater 10 has a hot water outlet 42 extending from the top of tank 12 through top pan 18. A cold water dip tube 44 connects to a cold water inlet 40 and extends downwardly through tank 12. As shown in the Figures, cold water dip tube 44 extends substantially toward the bottom of tank 12. Hot water outlet 42 connects to a hot water dip tube 46 which also extends downwardly within tank 12.

Figure 4:
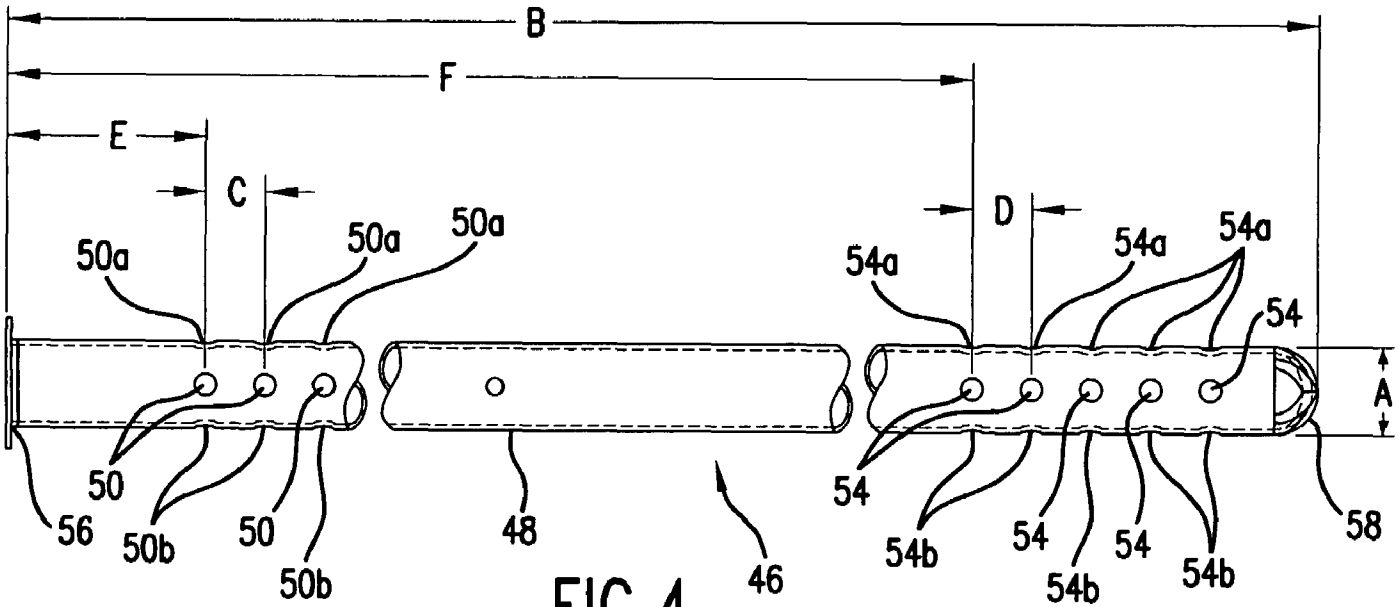
FIG. 4 is a front elevational view of a hot water outlet dip tube in accordance with aspects of the invention.
Figure 5:
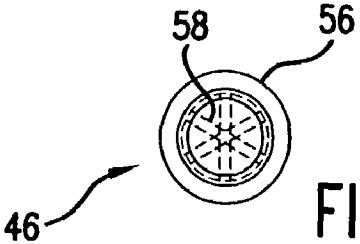
FIG. 5 is a bottom plan view of the dip tube of FIG. 4.

As also shown in connection with FIGS. 4 and 5, hot water dip tube 46 comprises an elongated, substantially cylindrical tube 48 having a multiplicity of openings. The openings comprise upper openings 50 and lower openings 54. The openings are spaced apart and numbered as set forth in more detail below.

Hot water dip tube 46 has on its upper end a flange 56 and on its lower end a so-called seal end 58. Seal end 58 can be closed or can be open in the "basket" shape as shown in FIGS. 4 and 5.

Hot water dip tube 46 may be formed from a variety of different types of material well known in the art and can have different diameters and lengths that are adapted to fit the size of hot water outlet 42 and the size of tank 12. Solely for the purpose of illustration, dip tube 46 as shown in FIGS. 4 and 5 is described in accordance with one exemplary form that is particularly suited for a water heater having a 50-gallon tank. Thus, the diameter of substantially cylindrical tube 48, as shown by arrows "A", is about 0.65 inches. The overall length of hot water dip tube 46, as shown by arrows "B", is about 22 inches. The diameter of openings 50 and 54 is about 0.188 inches. The space between the center points of openings 50, as shown by arrows "C", is about 0.44 inches. Similarly, the spacings between center points of openings 54, as shown by arrows "D", are about 0.44 inches.

The distance between flange 56 and the center point of upper opening 50 is about 1.44 inches, as shown by arrows "E". Finally, the distance between flange 56 and the center point of the uppermost one of lower openings 54 is about 19.5 inches, as shown by arrows "F".

It should be understood, however, that different dimensions associated with the various openings can be employed, depending on the size and shape of tank 12, as well as the length and diameter of hot water dip tube 46.

Also, the hot water dip tube 46 shown in FIGS. 4 and 5 has additional sets of upper openings 50 that match the three openings 50 that are directly shown in the drawings. Those other upper openings 50 include three additional sets of three openings 50 that are present on hot water dip tube 46 at three rotational spacings of 90° each. Two of those three additional sets of openings are labeled openings 50*a* and 50*b*, respectively. Similarly, with reference to lower openings 54, there are three additional sets of five openings at three locations at 90° rotational spacings. The additional sets of lower openings are labeled 54*a* and 54*b*, respectively. In each instance, with respect to openings 50 and 54, there are corresponding sets on the surfaces directly opposed to those openings at a rotation of 180°.

Referring back to FIG. 1 in particular, hot water dip tube 46 is shown with lower openings 54 at a location below element 30. On the other hand, openings 50 are shown at a location proximate to or adjacent hot water outlet 42. FIG. 1 has been labeled with arrows "H" and "I", respectively, to assist in better understanding the various locations of the upper and lower openings. In the case of openings 54, they are located in a space as set forth by arrows "H". As particularly shown in FIG. 1, lower openings 54 are substantially below element 26. However, lower openings 54 may be located further below element 30, extending downwardly almost to the bottom of tank 20, if desired. However, the configuration shown in FIG. 1 is particularly preferred.

The distance between the uppermost one of upper openings 50 and hot water outlet 42 are shown by arrows "I" in FIG. 1. This means that the upper openings 50 are proximate to or adjacent hot water outlet 42. In practice, the upper openings 50 are positioned below hot water outlet 42 in a range of about 1 inch to about 5 inches. It is especially preferred that the uppermost one of the upper openings 50 is below the hot water outlet by at least about 1 inch.

Referring to lower openings 54, the uppermost one of the lower openings 54 should be below element 26. Preferably, the uppermost one of the lower opening 54 should be at least about 1 inch below element 26.

In operation, when hot water is drawn from water heater 10, relatively hot water within tank 12, which is located in the uppermost portion of tank 12, is drawn through upper openings 50. However, simultaneously, relatively colder water is drawn into lower openings 54 wherein the relatively hotter water and the relatively colder water mix prior to exiting water heater 10. Nonetheless, the temperature of the hot water exiting the water heater is sufficiently high to meet the requirements of residential use.

A further advantage is that the first hour rating of the water heater increases substantially. The Applicants conducted a series of tests that demonstrate the dramatic increase in first hour water supply in accordance with this invention. The results are set forth in Table 1. The experiments were conducted on a water heater having a 50-gallon tank with upper and lower elements, as shown in FIGS. 1 and 2. The first two columns of Table 1 reflect Comparative Examples wherein a standard water heater was employed that did not contain a hot water dip tube. The following six columns were for similar water heaters equipped with hot water dip tubes.

TABLE 1

| | Comparative Ex. 1 | Comparative Ex. 2 | Ex. 1 | Ex. 2 | Ex. 3 | Ex. 4 | Ex. 5 | Ex. 6 |
|---|---|---|---|---|---|---|---|---|
| First Hour Supply | 60.80 | 57.84 | 74.23 | 75.80 | 79.10 | 73.75 | 72.31 | 77.24 |
| Average outlet temperature, Fahrenheit | 129.62 | 136.71 | 124.74 | 124.95 | 124.03 | 125.41 | 126.52 | 124.42 |
| Average inlet temperature, Fahrenheit | 57.51 | 57.80 | 57.19 | 57.09 | 57.30 | 57.30 | 57.45 | 57.28 |
| Water drawn during test, gallons | 70.39 | 57.84 | 76.52 | 75.80 | 78.32 | 73.75 | 72.31 | 77.24 |
| Total elapsed time of test, minutes | 64.27 | 60.27 | 60.78 | 61.67 | 65.80 | 61.38 | 60.98 | 62.05 |

It can be seen from the results of Table 1 that the first hour rating is increased from about 40% to about 60% greater than the capacity of the tank. This is compared to the standard first hour supply, which is only about 15–20% greater than the capacity of the tank. Accordingly, the improvement in the first hour rating is about 110% to about 120% greater than standard units. This is a significant improvement in the ability of an electric water heater to provide hot water in greater quantities which is a significant advantage to the user.

Although this invention has been described in connection with specific forms thereof, it will be appreciated that a wide variety of equivalents may be substituted for the specified elements described herein without departing from the spirit and scope of this invention as described in the appended claims.

What is claimed is:

1. An electric water heater comprising:

a water container;

an element associated with the water container to heat water in the water container;

a cold water inlet associated with the water container;

a hot water outlet associated with the water container; and a dip tube connected to the hot water outlet, the dip tube having at least one opening proximate the hot water outlet to receive water from the water container proximate the hot water outlet and at least one opening positioned proximate to or below the element to receive water from the water container proximate to or below the element.

2. The electric water heater of claim 1, further comprising a second element associated with the water container and positioned below the element.

3. The electric water heater of claim 2, wherein the at least one opening positioned proximate to or below the element is positioned above the second element.

4. The electric water heater of claim 1, wherein the at least one opening is positioned from about 1 inch from the hot water outlet to about 5 inches from the hot water outlet.

5. The electric water heater of claim 1, wherein the dip tube is about 0.5 to about 1 inch in diameter.

6. The electric water heater of claim 1, wherein the at least one opening proximate to or below the element is at least about 1 inch below the element.

7. The electric water heater of claim 1, wherein the at least one opening is positioned between about 1 inch from a top of the container to a position in an upper half of the water container between the top and the element.

8. The electric water heater of claim 1, further comprising a thermostat associated with the water container and a controller connected to the element and the thermostat.

9. The electric water heater of claim 1, having a first hour hot water supply about 40% to about 60% greater than the capacity of the water container.

10. An electric water heater comprising:

a water tank;

an upper element associated with the tank to heat water in the tank;

a lower element associated with the tank to heat water in the tank;

a cold water inlet positioned in a top portion of the tank;

a hot water outlet positioned in the top portion of the tank; and a dip tube connected to the hot water outlet and having a plurality of upper openings positioned between the top portion and the upper element, and a plurality of lower openings positioned proximate to or below the upper element.

11. The electric water heater of claim 10, wherein the lower openings are positioned above the lower element.

12. The electric water heater of claim 10, wherein the upper openings comprise sets of three openings on opposed sides of the dip tube rotated about 90° apart.

13. The electric water heater of claim 10, wherein the lower openings comprise sets of twenty openings on opposed sides of the dip tube rotated about 90° apart and positioned below the element.

14. The electric water heater of claim 10, wherein the upper openings are positioned from about 1 inch from the hot water outlet to about 5 inches from the hot water outlet.

15. The electric water heater of claim 10, wherein the lower openings are positioned below the element at least about 1 inch below the element.

16. The electric water heater of claim 10, further comprising a thermostat associated with the water container and a controller connected to the upper and lower elements and the thermostat.

17. The electric water heater of claim 10, having a first hour hot water supply about 40% to about 60% greater than the capacity of the water container.

18. A method of increasing first hour hot water supply from an electric water heater comprising a water tank, a heating element, a cold water inlet and a hot water outlet, comprising:

reducing the temperature of hot water passing through the hot water outlet by causing relatively colder water in the tank to mix with relatively hotter water in the tank by connecting a dip tube having at least one opening proximate the hot water outlet and at least one opening positioned proximate to or below the element to the hot water outlet such that the relatively hotter water enters through the at least one opening proximate the hot water outlet and the relatively colder water enters to the hot water outlet through the at least one opening proximate to or below the element.

19. The method of claim 18, wherein the first hour water supply is about 40% to about 60% greater than the capacity of the tank.

20. A method of increasing first hour water supply from an electric water heater comprising a water tank, an element, a cold water inlet and a hot water outlet, comprising:

mixing relatively colder water in the tank with relatively hotter water in the tank with a dip tube connected to the hot water outlet and having at least one opening adjacent a top portion of the tank to receive the relatively hotter water and at least one opening positioned proximate to or below the element to receive the relatively colder water.

21. The method of claim 20, wherein the first hour water supply is about 40% to about 60% greater than the capacity of the tank.

22. An electric water heater comprising:

a water container;

an element associated with the water container to heat water in the water container;

a cold water inlet associated with the water container;

a hot water outlet associated with the water container; and a dip tube connected to the hot water outlet, the dip tube having sets of three openings on opposed sides of the dip tube rotated about 90° apart proximate the hot water outlet and three sets of openings on opposed sides of the dip tube rotated about 90° apart positioned proximate to or below the element.

23. An electric water heater comprising:

a water container;

an element associated with the water container to heat water in the water container;

a cold water inlet associated with the water container;

a hot water outlet associated with the water container; and a dip tube connected to the hot water outlet, the dip tube having at least one opening proximate the hot water outlet and sets of twenty openings on opposed sides of the dip tube rotated about 90° apart and positioned below the element.

* * * * *